US005586609A

United States Patent [19]

Schuh

[11] Patent Number: 5,586,609

[45] Date of Patent: Dec. 24, 1996

[54] METHOD AND APPARATUS FOR DRILLING WITH HIGH-PRESSURE, REDUCED SOLID CONTENT LIQUID

[75] Inventor: Frank J. Schuh, Plano, Tex.

[73] Assignee: Telejet Technologies, Inc., Dallas, Tex.

[21] Appl. No.: 356,656

[22] Filed: Dec. 15, 1994

[51] Int. Cl.[6] ..... E21B 17/18; E21B 21/12

[52] U.S. Cl. ..... 175/65; 175/215

[58] Field of Search ..... 166/65.1, 242; 175/70, 65, 215, 217, 218

[56] References Cited

U.S. PATENT DOCUMENTS

| | | | |
|---|---|---|---|
| 2,092,822 | 9/1937 | West | 255/72 |
| 2,425,193 | 8/1947 | Lehr | 255/1.8 |
| 2,951,680 | 9/1960 | Camp et al. | 255/1.8 |
| 3,075,589 | 1/1963 | Grable et al. | 175/215 |
| 3,268,017 | 8/1966 | Yarbrough | 175/25 |
| 3,283,835 | 11/1966 | Kellner | 175/317 |
| 3,323,604 | 6/1967 | Henderson | 175/215 |
| 3,783,942 | 1/1974 | Mott | 166/244 |
| 3,835,943 | 9/1974 | Bray | 175/215 X |
| 4,100,981 | 7/1978 | Chaffin | 175/60 |
| 4,134,619 | 1/1979 | Bunnelle | 175/215 X |
| 4,391,328 | 7/1983 | Aumann | 166/325 |
| 4,624,327 | 11/1986 | Reichman | 175/67 |
| 4,676,563 | 6/1987 | Curlett et al. | 439/194 |
| 4,682,661 | 7/1987 | Hughes et al. | 175/215 |
| 4,683,944 | 8/1987 | Curlett | 175/47 |
| 4,718,503 | 1/1988 | Stewart | 175/70 |
| 5,186,266 | 2/1993 | Heller | 175/215 |

FOREIGN PATENT DOCUMENTS

| | | | |
|---|---|---|---|
| WO86/02403 | 4/1986 | WIPO | E21B 3/00 |
| WO91/17339 | 11/1991 | WIPO | E21B 21/12 |

OTHER PUBLICATIONS

PCT Search Report PCT/US95/16307 Jun. 5, 1996.

*Primary Examiner*—Frank Tsay

*Attorney, Agent, or Firm*—Robert A. Felsman; Mark D. Perdue

[57] ABSTRACT

A drillstring terminating in a drill bit is run into a borehole. A reduced solid content drilling fluid is pumped through the drillstring and out the bit, wherein the drilling fluid impinges upon and disintegrates formation material in cooperation with the bit. An annulus fluid having a density greater than that of the drilling fluid is continuously pumped into the annulus between the borehole and drillstring, wherein the annulus fluid extends substantially from the surface to the bottom of the drillstring. Drilling fluid and cuttings resulting from disintegration of formation material are returned to the surface through a substantially unobstructed tubular passage in the drillstring. The annulus fluid is maintained under a selected and controlled pressure in the annulus, wherein an interface is formed at the drill bit at which annulus fluid mixes with the drilling fluid and is returned along with the drilling fluid and cuttings and drilling fluid is substantially prevented from entering the annulus.

37 Claims, 6 Drawing Sheets

METHOD AND APPARATUS FOR DRILLING WITH HIGH-PRESSURE, REDUCED SOLID CONTENT LIQUID

BACKGROUND OF THE INVENTION

1. Field of the Invention

The present invention relates generally to methods and apparatus for drilling earthen formations. More particularly, the present invention relates to methods and apparatus for drilling earthen formations for the recovery of petroleum using high-pressure, reduced solid content liquid.

2. Background Information

It is a long-standing practice in the rotary drilling of wells to employ a drilling fluid. In most cases, the drilling fluid is a dense, filter-cake-building mud to protect and retain the wall of the borehole. The mud is pumped through the tubular drillstring, exits nozzles in the drill bit, and is returned to the surface in the annulus between the drillstring and the sidewall of the borehole. This fluid cools and lubricates the drill bit as well as providing a hydrostatic fluid column to prevent gas kicks or blowouts, and builds filter cake on formation in the sidewall of the borehole. The drilling fluid exits the bit through nozzles to strike the bottom of the well with a velocity sufficient to rapidly wash away the cuttings created by the teeth of the bit. It is known that the higher velocity of the fluid, the faster will be the rate of drilling, especially in the softer formations that can be removed with a high-velocity fluid.

Although mud hydraulics using higher nozzle velocities are well-known to beneficially affect the rate of penetration of the bit, generally the drilling fluid is not employed as a primary mechanism for the disintegration of formation material. One reason for this is that conventional drilling muds are quite abrasive, even though there is effort to reduce the amount of abrasives. The pressures required to generate hydraulic horsepower sufficient to actively disintegrate formation material cause extreme abrasive wear on the drill bit, especially the nozzles, and associated drillstring components when abrasive particles are in the drilling fluid. Use of clear water or a non-abrasive fluid would solve the abrasion problem, but the density and characteristics of such fluids cannot substitute for the dense, filter-cake-building drilling mud in formations that are porous or tend to slough-off. Nor can clear water be used when high-pressure gas may be encountered and a high-density fluid is required to prevent a blowout.

Attempts have been made to employ a high-pressure, reduced solid content drilling fluid together with a dense, filter-cake-building drilling mud to achieve the advantages of both. U.S. Pat. No. 2,951,680, Sep. 6, 1960, to Camp discloses a two-fluid drilling system in which an inflatable packer is rotatably coupled to the drillstring just above the drill bit. In drilling operation, the packer is inflated and the annulus between the drillstring and the borehole wall above the packer is filled with conventional drilling mud. Gaseous or reduced density drilling fluid is pumped down through the drillstring and exits a nozzle in the bit. The packer prevents mixing of the drilling and annulus fluids. The cutting-laden drilling fluid is returned to the surface through a port in the sidewall of the drillstring below the packer and a conduit formed within the drillstring. The presence of a packer near the drill bit in the drillstring poses design and reliability problems. Additionally, the cutting-laden drilling fluid is returned through a tortuous passage in the drillstring, which is likely to become clogged with cuttings.

U.S. Pat. No. 3,268,017, Aug. 23, 1966, to Yarbrough discloses a method and apparatus for drilling with two fluids in which a two-tube, concentric drillstring is employed. Clear water is employed as the drilling fluid and is pumped down through the inner tube of the drillstring and exits the bit. A wall-coating drilling mud or fluid is maintained in the annulus between the drillstring and the borehole. Cutting-laden drilling fluid is returned to the surface through the annulus defined between the inner and outer concentric tubes of the drillstring. The height of the column of wall-coating drilling mud is monitored and pressure in the drilling fluid is increased responsive to pressure increases resulting from changes in the hydrostatic pressure associated with the column of wall-coating liquid between the drillstring and borehole wall. Returning the cutting-laden fluid in an annulus between inner and outer conduit in a drillstring would be problematic because the annulus would tend to clog and would be very difficult to clean. Additionally, monitoring the pressure exerted by the annulus fluid by measuring its height in the wellbore would be extremely difficult to accomplish if annulus fluid or drilling mud is continuously pumped into the annulus, which is necessary to maintain the annulus fluid or drilling mud over the entire length of borehole as drilling progresses.

U.S. Pat. No. 4,718,503, Jan. 12, 1988, to Stewart discloses a method of drilling a borehole in which a drill bit is coupled to the lower end of a pair of concentric drill pipes. A first low-viscosity fluid, such as oil and water, is pumped down through the inner drill pipe and returned to the surface through the annulus between the inner and outer drill pipes. A column of annulus fluid or drilling mud is maintained stationary in the annulus formed between the borehole wall and the outer of the drill pipes. When it becomes necessary to make-up a new section of drill pipe, filter-cake-building drilling mud is pumped down the inner drill pipe to displace the clear drilling fluid, wherein only the dense, filter-cake-building annulus fluid or drilling mud occupies the borehole. Such a procedure for the make-up of new sections of drill pipe is extremely unwieldy, and in practice is uneconomical.

A need exists, therefore, for a method and apparatus for drilling with a reduced density drilling fluid while maintaining a dense, filter-cake-building annulus fluid in the annulus that is commercially practical.

SUMMARY OF THE INVENTION

It is a general object of the present invention to provide an improved method and apparatus for drilling a borehole using a high-pressure, reduced solid content drilling fluid, while maintaining an annulus fluid having a density greater than that of the drilling fluid in the annulus between the borehole and the drillstring while drilling.

This and other objects of the present invention are accomplished by running a drillstring terminating in a drill bit into a borehole. A reduced solid content drilling fluid is pumped through the drillstring and out the bit, wherein the drilling fluid impinges upon and disintegrates formation material in cooperation with the bit. An annulus fluid having a density greater than that of the drilling fluid is continuously pumped into the annulus between the borehole and drillstring, wherein the annulus fluid extends substantially from the surface to the bottom of the drillstring. Drilling fluid and cuttings resulting from disintegration of formation material are returned to the surface through a substantially unobstructed tubular passage in the drillstring. The annulus fluid is maintained under a selected and controlled pressure, wherein an interface is formed at the drill bit at which annulus fluid mixes with the drilling fluid and is returned along with the drilling fluid and cuttings, and the drilling fluid is substantially prevented from entering the annulus.

According to the preferred embodiment of the present invention, the step of maintaining the annulus fluid under a selected and controlled pressure further comprises selectively choking the return flow of drilling fluid, cuttings, and annulus fluid at the surface to control the pressure loss across the choke. Drilling fluid is also pumped into the drillstring at a flow rate sufficient to maintain the interface between the drilling and annulus fluids as drilling progresses. The selected and controlled pressure of the annulus fluid and the rate of choking the drilling fluid are monitored to insure the maintenance of the interface therebetween at the bit.

According to the preferred embodiment of the present invention, the method further comprises shutting-in the drilling fluid, including the drilling fluid and cuttings in the tubular passage, in the drillstring at the surface and at the bit. A length of drill pipe is connected into the drillstring while it is shut-in and the drillstring then is opened to continue drilling.

According to the preferred embodiment of the present invention, the drilling fluid is clear water or clarified drilling mud and the annulus fluid is a dense, filter-cake-building drilling mud.

According to the preferred embodiment of the present invention, the drillstring comprises a multiple conduit drill pipe having an outer tubular conduit for transmitting tensile and torsional load. Means are provided at each end of the outer tubular conduit for connecting the drill pipe to other sections of drill pipe. At least one reduced-diameter tubular conduit for conducting high-pressure fluid is eccentrically disposed within the tubular outer conduit. At least one enlarged-diameter tubular conduit is eccentrically disposed in the outer conduit and a closure member is disposed therein for selectively obstructing the enlarged-diameter tubular conduit. The closure member does not substantially constrict the diameter of the enlarged-diameter tubular conduit in the open position.

Other objects, features and advantages of the present invention will become apparent with reference to the detailed description which follows.

DESCRIPTION OF THE PREFERRED EMBODIMENT

Figure 1:
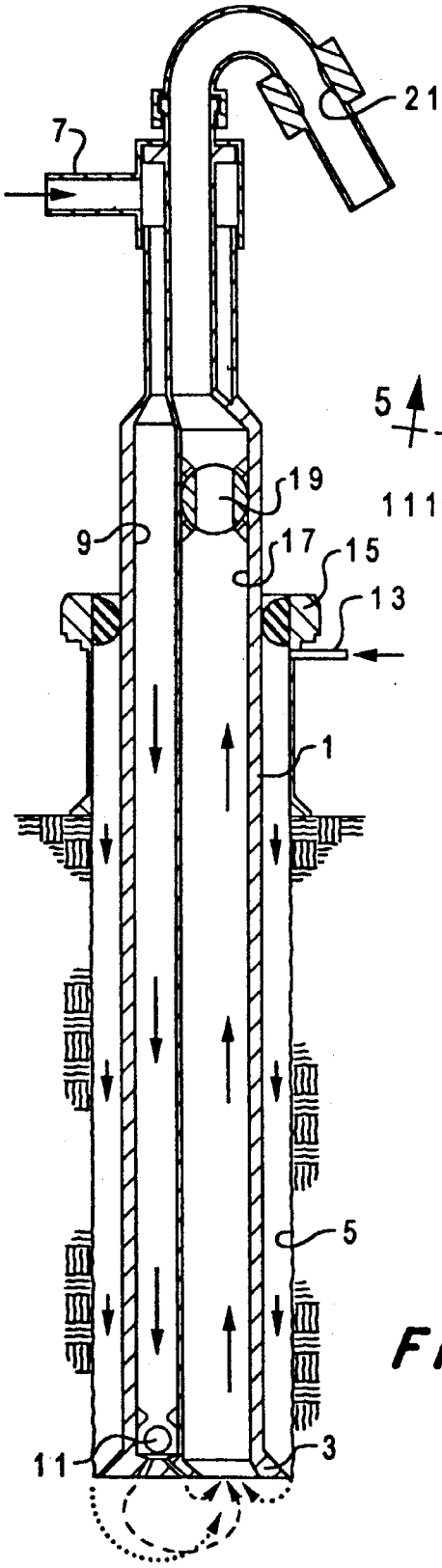
FIG. 1 is a schematic depiction of the method and apparatus according to the preferred embodiment of the present invention.

Referring now to the Figures, and specifically to FIG. 1, a schematic depiction of the method of drilling a borehole according to the present invention is illustrated. A drillstring 1, which terminates in a drill bit 3, is run into a borehole 5. A reduced-density or solid content drilling fluid 3 is pumped into drillstring 1 through a drilling fluid inlet 7 at the swivel. The drilling fluid may be clear water or clarified drilling mud, but should have a density less than that of conventional drilling muds and should have reduced solid content to avoid abrasive wear. Preferably, the drilling fluid is water with solid matter no greater than seven microns in size. The drilling fluid preferably is provided to drillstring 1 at 20,000 psig pump pressure in order to provide up to 3,200 hydraulic horsepower at bit 3. The pressurized water is carried through drillstring 1 through at least one reduced-diameter high-pressure conduit 9 extending through drillstring 1 and in fluid communication with bit 3. A check valve 11 is provided at or near bit 3 to prevent reverse circulation of the drilling fluid, as will be described in detail below.

Concurrently with the delivery of high-pressure drilling fluid through inlet 7, a dense, filter-cake-building annulus fluid is pumped into the annulus between drillstring 1 and borehole 5 through an annulus fluid inlet 13 below a rotating blowout preventer 15. Rotating blowout preventer 15 permits drillstring 1 to be rotated while maintaining the annulus fluid under a selected and controlled pressure. The annulus fluid is a conventional drilling mud selected for the particular properties of the formation materials being drilled and other conventional factors. The annulus fluid is pumped into the annulus continuously to maintain a column of annulus fluid extending from the surface to bit 3. The annulus fluid must be continuously pumped to maintain this column as drilling progresses. As described in more detail below, the pressures and injection or pump rates of the high-pressure drilling fluid and the annulus fluid are controlled and monitored to maintain an interface between the drilling and annulus fluids at bit 3 such that drilling fluid is substantially prevented from entering the annulus and diluting the dense, filter-cake-building fluid. However, some of the annulus fluid is permitted to mix with drilling fluid and return to the surface through return conduit 17. The method according to the preferred embodiment of the present invention is especially adapted to be automated and computer controlled using conventional control and data processing equipment.

The hydraulic horsepower resulting from high-pressure drilling fluid delivery at bit 3 combines with the conventional action of bit 3 to disintegrate formation material more efficiently. The drilling fluid and cuttings generated from the disintegration of formation material are returned to the surface through a substantially unobstructed tubular return passage 17 in drillstring 1. The term "substantially unobstructed" is used to indicate a generally straight tubular passage without substantial flow restrictions that is capable of flowing substantial quantities of cutting-laden fluid and is easily cleaned should clogging or stoppage occur. Substantially unobstructed tubular passage 17 is to be distinguished from the annulus resulting from concentric pipe arrangements, which is susceptible to clogging and is not easily cleaned in that event. The return flow of the drilling fluid and cuttings is selectively choked at the surface by a choke valve member 21 in the swivel to insure maintenance of the interface between the drilling and annulus fluids at bit 3.

A ball valve 19 is provided in return conduit 17 at the generally uppermost end of drillstring 1 to facilitate the making-up of new sections of pipe into drillstring 1. The lower density drilling fluid present in high-pressure conduit 9 and return conduit 17 is especially susceptible to being blown out of drillstring 1, either by hydrostatic pressure from the annulus fluid or from formation pressures, especially when pump pressure is not applied and when return flow is not fully choked in return conduit 17. When drilling is ceased, ball valve 19 is closed at the surface, thereby shutting-in drilling fluid in return conduit 17. Check valve 11, combined with the hydrostatic pressure of drilling fluid above it, shuts-in high-pressure conduit 9. A new section of drill pipe then may be added to drillstring 1, and ball valve 19 opened to recommence drilling. Before a new section of drill pipe is connected into drillstring 1, at least return conduit 17 should be filled with fluid to avoid a large pressure surge when ball valve 19 is opened. Similarly, drilling may be ceased safely for any reason, such as to trip drillstring 1 to change bit 3 or for any similar purpose.

Figure 2:
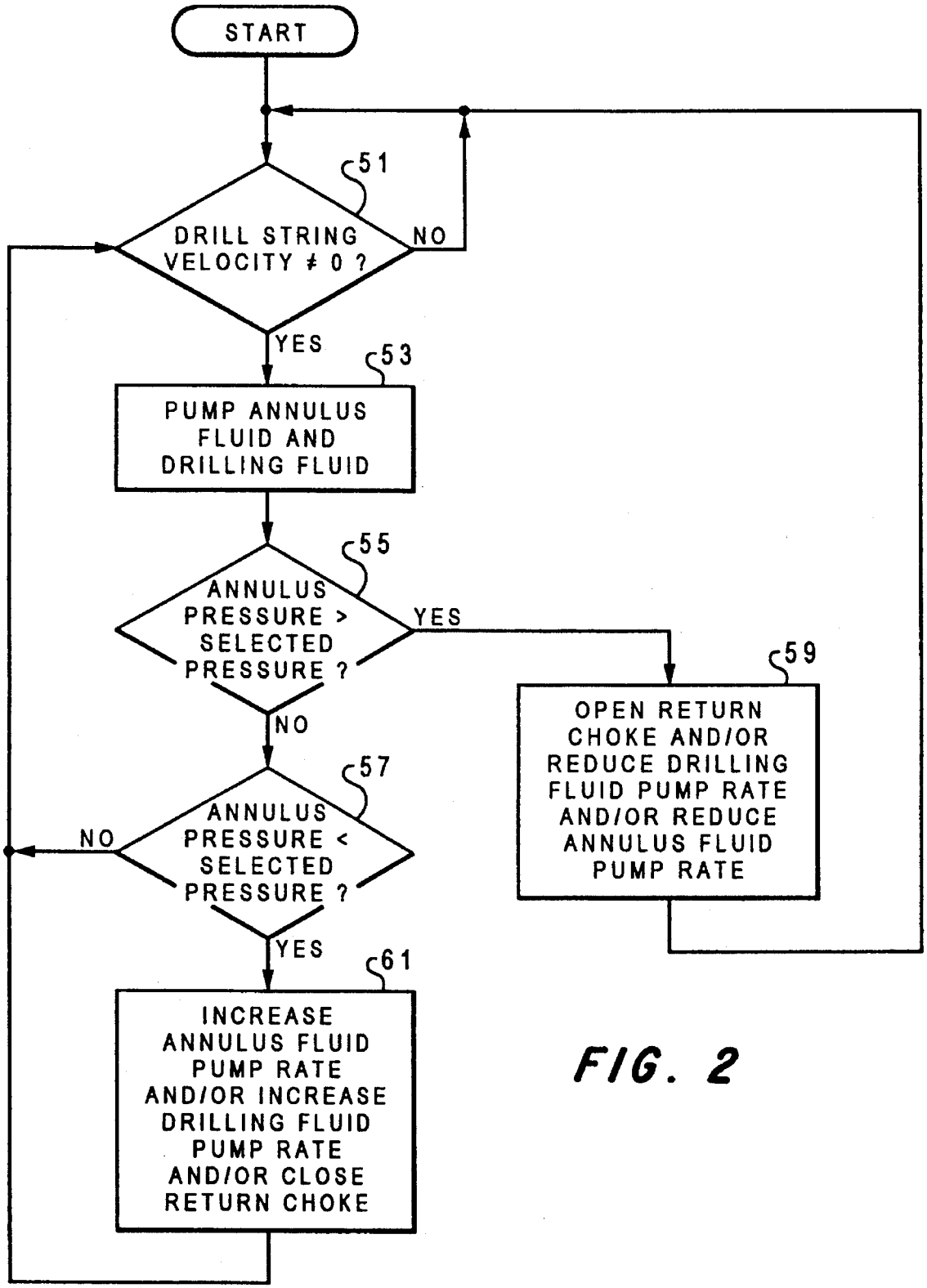
FIG. 2 is a logical flowchart depicting the steps of the process of controlling the method and apparatus according to the present invention.

FIG. 2 is a flowchart depicting the control of fluids in drillstring 1 during drilling operation according to the method of the present invention. At block 51, the axial velocity of drillstring 1 is monitored. This is accomplished by measuring the hook load exerted on, and the axial position of, the top drive unit (not shown) that will rotate drillstring 1 during drilling operation. According to the preferred embodiment of the present invention, the annulus and drilling fluids are pumped whenever drillstring 1 is moving downward, a condition associated with drilling operation. Clearly, annulus and drilling fluids should be pumped during downward movement of drillstring associated with drilling. In most operations, the only time that it is not advantageous to pump one or both of the annulus and drilling fluids is when the drillstring 1 is not moving and its velocity is zero. If drillstring velocity is not equal to zero, at least annulus fluid is being pumped into the borehole. Preferably, annulus fluid is pumped automatically as a multiple of drillstring 1 velocity at all times that the velocity of drillstring 1 is not equal to zero and drilling related operations are occurring. Preferably, except as noted below, pumping of drilling fluid is controlled manually by the operator.

When tripping drillstring 1, annulus fluid is pumped into the borehole at a rate sufficient to replace the volume of the borehole no longer occupied by drillstring 1. Thus, the borehole remains protected at all times.

Thus, at block 53, if the drillstring 1 is moving, at least annulus fluid is being pumped into the borehole. If the velocity of drillstring 1 is positive, indicating drilling operation, both annulus and drilling fluids are pumped into the borehole. The drilling fluid is pumped into drillstring 1 at a pressure sufficient to generate 20 to 40 hydraulic horsepower per square inch of bottom hole area at depths between 7,000 and 15,000 feet. Based on the dimensions of drillstring 1 set forth in connection with FIGS. 3–7D, and other operating parameters, the drilling fluid is delivered into drillstring 1 at the surface at a consistent pressure of 20,000 psig and a flow rate of 300 gallons per minute.

Annulus fluid is pumped into the annulus at a rate that continuously sweeps the annulus fluid past bit 3 whenever drillstring 1 is moving axially. During normal drilling operations, this will maintain a continuous flow of annulus fluid past the periphery of bit 3 and will not only maintain the interface at the bottom of the borehole, but will purge the annulus of cuttings or other debris. The injection rate for the annulus fluid is set as a function of the axial downward velocity of drillstring 1. A preferred or typical injection rate is one that would maintain the annulus fluid moving at a velocity double that of drillstring 1. This pump or injection rate is maintained at all times drillstring 1 is moving.

In addition to the pump or injection rate, a selected positive pressure is maintained on the annulus fluid at the surface, and this pressure is monitored just below rotating blowout preventer 15. This selected pressure is not a single, discrete pressure, but is a pressure range, preferably between about 60 and 70 psig. This pressure is monitored by conventional pressure-sensing apparatus on blowout preventer 15.

To insure maintenance of the selected positive pressure, at block 55, the annulus pressure is measured and compared to the selected pressure. If the annulus pressure exceeds the selected pressure, the annulus pressure is reduced. There are three options for reducing the annulus pressure:

1) open choke 21 in return line 17 to reduce the pressure loss across choke 21;

2) reduce the injection or pump rate of drilling fluid; and 3) reduce the injection or pump rate of the annulus fluid.

Opening choke 21 is the preferred option for reducing the annulus pressure to the selected range. If this is unsuccessful, the injection or pump rate of the drilling fluid is reduced or restricted automatically, notwithstanding the operator's selected injection or pump rate. As a final resort, the injection or pump rate of the annulus fluid is reduced below the selected rate based on velocity of the drillstring. Reduction or restriction in the injection or pump rate of the annulus fluid is the last resort for reduction in the annulus pressure because of the necessity to maintain a column of undiluted annulus fluid extending from the surface to bit 3. Reduction of the injection or pump rate of the annulus fluid as a last resort for reduction in the annulus pressure minimizes the risk that the drilling fluid will mix with and dilute the annulus fluid.

At block 57, if the annulus pressure is below the selected pressure, it is increased, at block 61. There are three options for increasing the annulus pressure:

1) increase the injection or pump rate of the annulus fluid back to the selected rate;

2) increase the injection or pump rate of the drilling fluid up to the operator selected rate; and 3) close or restrict choke 21 in return line 17 to increase the pressure loss across choke 21.

The first option is pursued if the injection or pump rate is, for some reason, insufficient to maintain the velocity of annulus fluid in excess of and preferably double the velocity of drillstring 1. If the injection or pump rate of the annulus fluid is adequate, the second option may be pursued. However, it is contemplated that the drilling fluid pumps are operating at or near peak capacity and that significant increases in the injection or pump rate of the drilling fluid may not be feasible. In that case, the third option of closing choke or valve member 21 in return line 17 is pursued.

If the annulus pressure is within the selected range, no action is taken and the velocity of drillstring 1 and annulus pressure are continuously monitored. If drilling operations cease, and/or the operator reduces the injection or pump rates of drilling fluid, the annulus pressure will drop off and choke 21 will close automatically, effectively shutting-in drillstring 1 and the borehole, until further action is taken.

Figure 3:
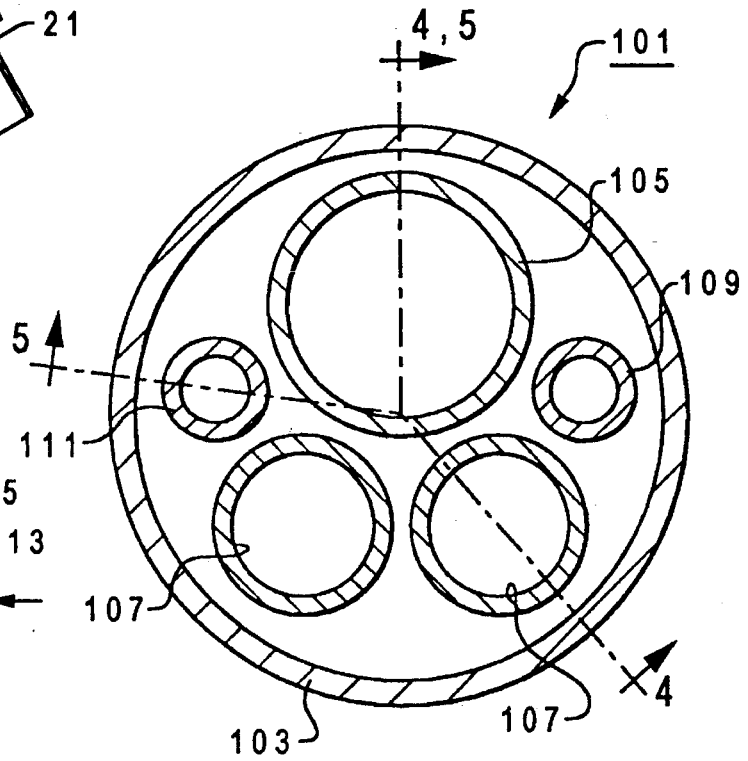
FIG. 3 is a cross-section view of the multiple conduit drill pipe according to the preferred embodiment of the present invention.

FIG. 3 is a cross-section view of a section of multiple conduit drill pipe 101 according to the preferred apparatus for the practice of the method according to the present invention. Drill pipe 101 comprises an outer tube 103, which serves to bear tensile and torsional loads applied to drill pipe 101 in operation. Preferably, outer tube 103 has a 7⅝ inch outer diameter and is manufactured from API materials heat-treated to achieve an S135 strength rating. A plurality of inner tubes are housed eccentrically and asymmetrically within outer tubes 103 and serve as fluid transport conduits, electrical conduits, and the like.

These inner conduits include a 3½ inch outer diameter return tube 105, which generally corresponds to return conduit 17 in FIG. 1. Because return tube 105 is not designed to carry extremely high-pressure fluids and for enhanced corrosion resistance, it is formed of API material heat-treated to L80 strength rating. A pair of 2⅜ inch outer diameter high-pressure tubes 107 are disposed in outer tube 103 and generally correspond to high-pressure conduit 9 in FIG. 1. Because high-pressure tubes 107 must carry extremely high-pressure fluids, they are formed of API material heat-treated to API S135 strength rating. Other tubes 109, may be provided in outer tube 102 to provide electrical conduits and the like. Tube 111 is not actually a tube, but is a portion of a check valve assembly that is described in greater detail with reference to FIG. 5, below.

Figure 4:
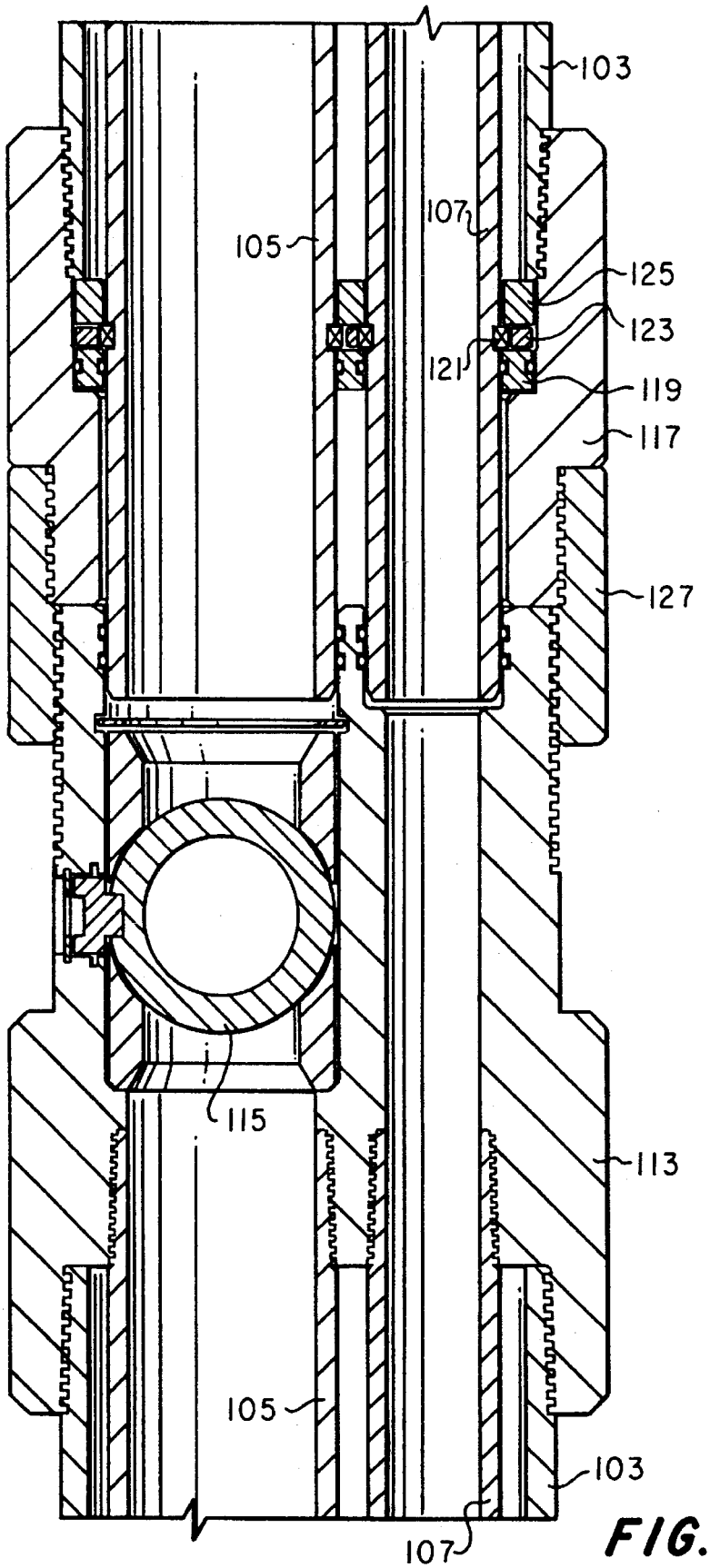
FIG. 4 is a longitudinal section view, taken along line 4—4 of FIG. 3, depicting a portion of the drill pipe illustrated in FIG. 4.

FIG. 4 is a longitudinal section view, taken along section line 4—4 of FIG. 3, depicting a pair of drill pipes 101 according to the present invention secured together. As can be seen, outer tube 103, return tube 105, and high pressure tube 107 are secured by threads to an upper end member 113. Upper end member 113 is formed similarly to a conventional tool joint and include a 3½ inch outer diameter, 10,000 psig-rated, bottom-sealing ball valve 115 in general alignment with return tube 105. Ball valve 115 has an inner diameter of approximately 2⅜ inch and does not present a substantial obstruction or flow restriction in return tube 105. Ball valve 115 corresponds to valve or closure member 19 in FIG. 1.

The lower end of outer tube 103 is secured by threads to a lower end member 117, which is also formed generally as a conventional tool joint. A seal ring 119 is received in lower end member 117 and serves to seal the interior of drill pipe 101 against return tube 105 and high-pressure tubes 107. A plurality of split rings 121 mate with circumferential grooves in return tube 105 and high-pressure tubes 107, and are confined in lower end member 117 by lock rings 123, 125 and outer tube 103. Split ring 121 and lock rings 123, 125 serve to constrain the inner tubes against axial movement relative to the remainder of the drill pipe 101. Unless the inner tubes of drill pipe 101 are secured against axial movement at each end of the drill pipe, the tubes will be subject to undue deformation due to high-pressure fluids and vibrations during operation.

Upon make-up of sections of drill pipe 101, the lower ends of inner tubes (only return tube 105 and high-pressure tube 107 are illustrated) are received in upper end member 113 and sealed by conventional elastomeric seals. A locking ring mechanically couples together the threaded joints of upper and lower 117 end members. Lower end member 117 is provided with threads of larger pitch diameter than those of upper end member 113 such that locking ring 127 may be fully disengaged from lower end member 117 while carried by threads on upper end member The threads on locking ring 127 are formed to generate an axial contact force of approximately one million pounds between upper 113 and lower 117 end members. Preferably, each section of drill pipe 101 is 45 feet in length.

Figure 5:
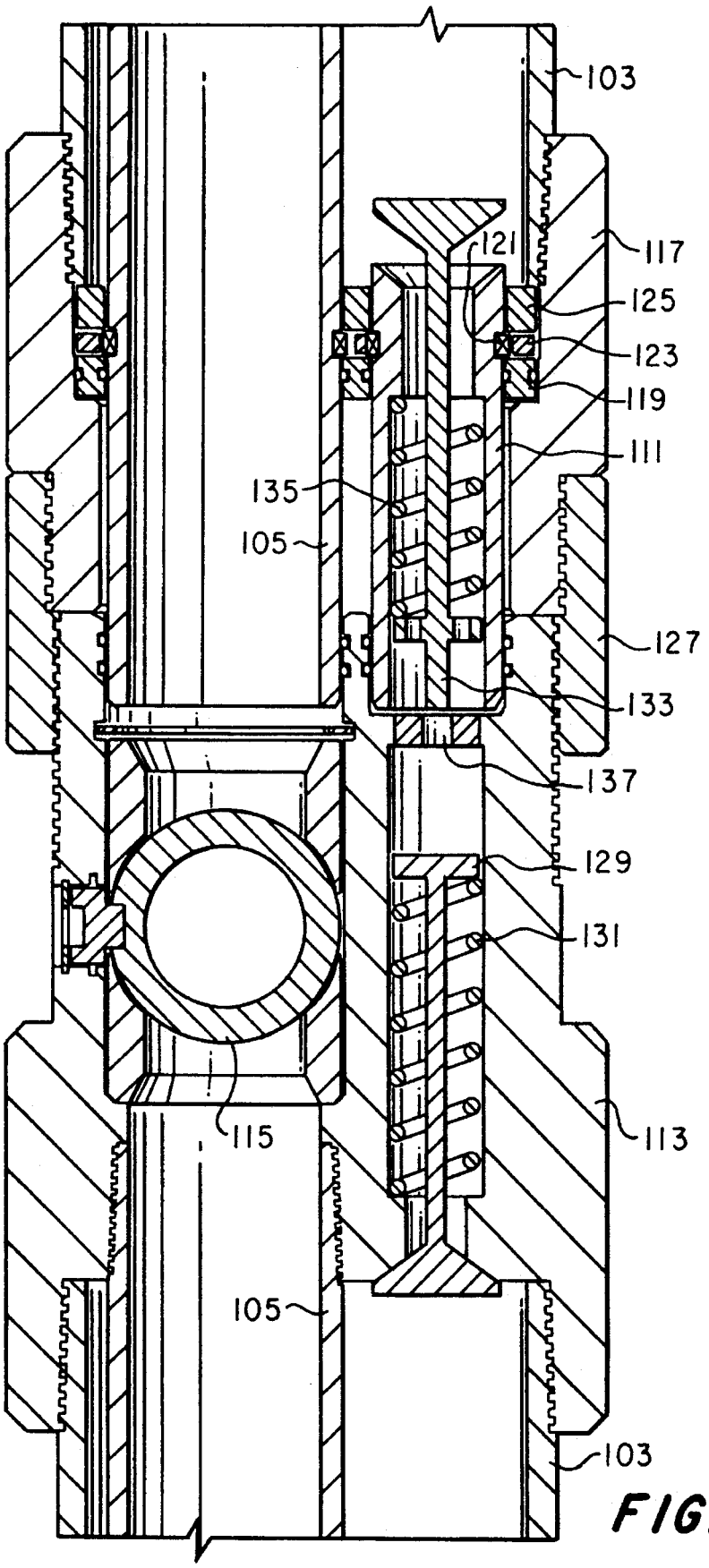
FIG. 5 is a longitudinal section view, taken along line 5—5 of FIG. 3, depicting a portion of the drill pipe illustrated in FIG. 4.

FIG. 5 is a longitudinal section view, taken along section 5—5 of FIG. 3, depicting a check valve arrangement by which downward fluid communication can be established between the annulus defined between the inner tubes 105, 107 and outer tube 103 of drill pipe 101. A check valve assembly is disposed in a bore in upper end member 113. The check valve comprises a conventional valve member 129 biased upwardly by a coil spring 131 to permit fluid flow downwardly through drill pipe 101, but not upwardly.

A somewhat similar check valve arrangement is provided in lower end member 117. The check valve assembly includes a poppet member 133 and a coil spring 135 carried in a sleeve 111, which is secured to lower end member 119 similarly to return tube Unlike the check valve assembly in upper end member 113, the purpose of the check valve assembly in lower end member 119 is to prevent loss of fluids from the interior of drill pipe 101 when two sections are uncoupled. Upon make-up of two sections, an extension of poppet valve 131 engages a lug or boss 137 on upper end member 113, opening poppet 131 and permitting fluid communication between the interior of outer tube 103 of successive sections of drill pipe 101.

With this check valve arrangement, the interior or annular portion of outer tubes 103 can be filled with annulus fluid or the like, and one-way, downward fluid communication through outer tubes 103 can be established. This fluid communication is necessary to equalize the pressure differential between the interior and the exterior of drill pipe 101 at depth. Equalization is accomplished by pumping a small quantity of fluid into the interior annulus of drillstring 101, which is communicated downwardly through the check valves to equalize pressure.

Figure 6A:
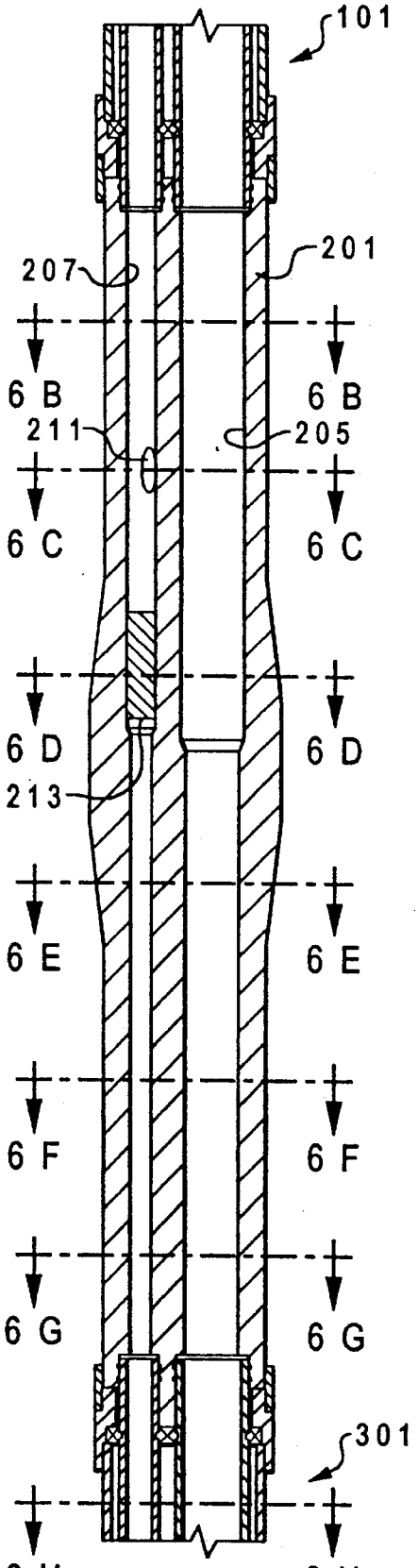
FIG. 6A–6H should be read together and are a longitudinal section and several cross-section views of a crossover stabilizer for use with the multiple conduit drill pipe according to the preferred embodiment of the present invention.

FIGS. 6A–6H should be read together and are section views of a crossover stabilizer 201 for use with drill pipe or drillstring 101 according to the preferred embodiment of the present invention. FIG. 6A is a longitudinal section view, while FIGS. 6B–6H are cross section views, taken along the length of FIG. 6A at corresponding section lines of crossover stabilizer 201. Crossover stabilizer 201 is formed from a single piece of nonmagnetic material to avoid interference with measurement-while-drilling ("MWD") equipment. Crossover stabilizer 201 is coupled to the lower end of a section of drillpipe 101 generally as described with reference to FIGS. 4 and 5.

Figure 6B:
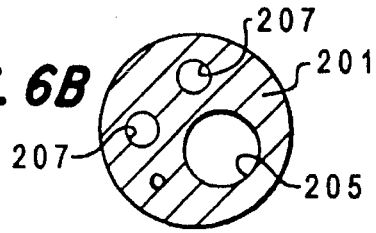
Figure 6C:
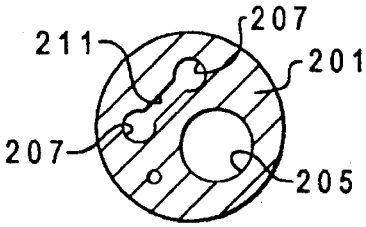

A plurality of bores 205, 207 are formed through crossover stabilizer 201 and correspond to high-pressure tubes 107 and return tube 105 of drill pipe 101, as shown in FIG. 6B. A crossover port 211 is formed in the sidewall of one of the high-pressure bores 207 to communicate high-pressure drilling fluid from one of bores 207 to the other, as illustrated in FIG. 6C.

Figure 6D:
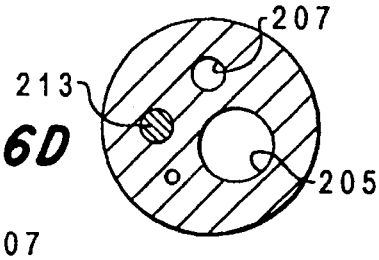
Figure 6E:
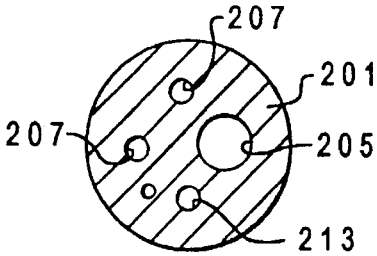
Figure 6F:
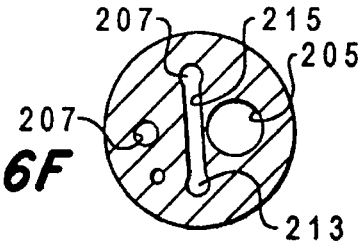

A retrievable plug 213 is provided in one of bores 207 below port 211 to block bore 207, as shown in FIG. 6D. The remainder of bore 207 below plug 213 houses a conventional retrievable directional MWD apparatus. Plug 213 serve to prevent high-pressure drilling fluid from impacting the MWD apparatus. Below plug 213, bores 205, 207 are reduced in diameter to provide space for another high-pressure drilling fluid bore 213 arranged generally opposite bore 207, as shown in FIG. 6E. As shown in FIG. 6F, a crossover bore 215 connects bore 207 with bore 213, such that high-pressure drilling fluid is carried by one bore 207 and another 213, which are arranged generally oppositely one another.

Figure 6G:
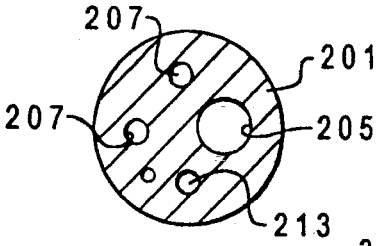
Figure 6H:
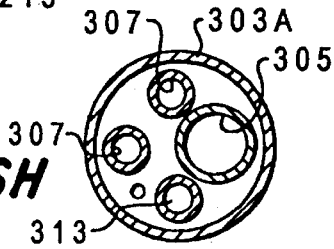

Arrangement of bores 207, 213 opposite one another tends to neutralize any bending moment generated by high-pressure fluids carried in the bores. As described above, other bore 207 houses an MWD apparatus, as shown in FIG. 6G. Crossover stabilizer 201 is connected to the uppermost portion of a bottomhole assembly 301, which comprises a section of drillpipe generally similar to that described with reference to FIGS. 4 and 5, but having inner tubes arranged to correspond with bores 205, 207, 213 of crossover stabilizer 201, as shown in FIG. 6H.

Figure 7A:
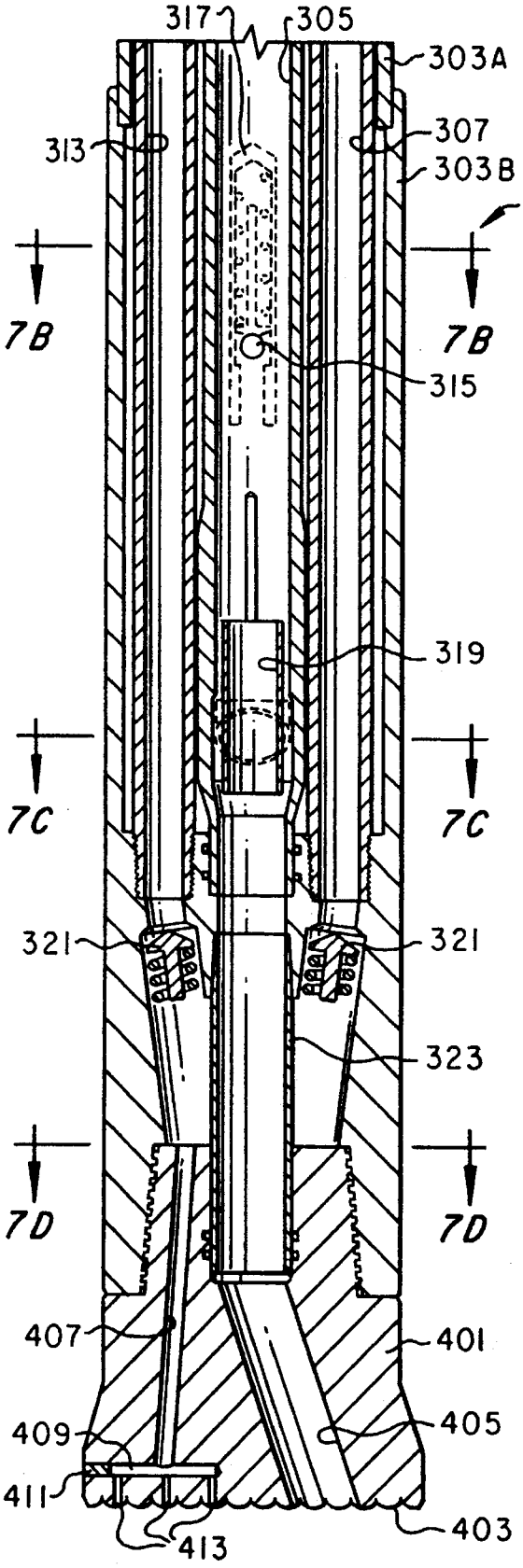
FIGS. 7A–7D should be read together and are a longitudinal section and several cross-section views of a bottom hole assembly for use with the multiple conduit drill pipe and crossover stabilizer according to the preferred embodiment of the present invention.
Figure 7B:
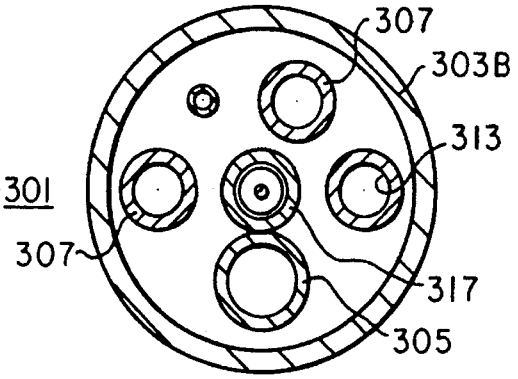
Figure 7C:
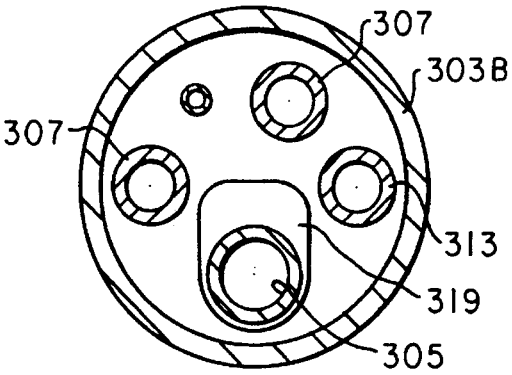
Figure 7D:
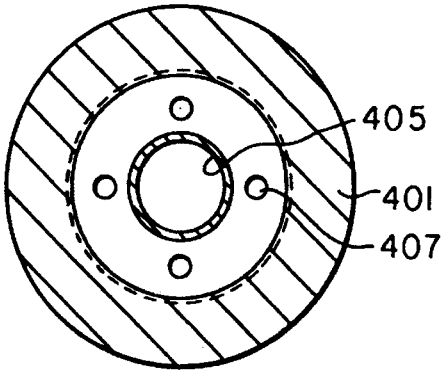

FIG. 7A–7D are sectional views of a bottomhole assembly 301 and bit 401 according to the preferred embodiment of the present invention. FIG. 7A is a longitudinal section view of bottomhole assembly 301 and bit 401. FIGS. 7B–7D are cross-section views, taken along the length of FIG. 7A at corresponding section lines, of assembly 301 and bit 401. As seen with reference to FIGS. 7A and 7B, bottomhole assembly 301 includes an upper outer tube 303A, which is coupled to crossover stabilizer 201 as described in connection with FIGS. 4 and 5. An enlarged-diameter lower tube 303B is coupled to upper outer tube 303B to provide more space in bottom hole assembly Lower outer tube 303B is threaded at its lower extent to receive inner tubes 307 and 313, which maintain the opposing arrangement established by crossover stabilizer 201. Return tube 305 is sealingly engaged with lower outer tube 303B to permit rotation and facilitate assembly. A port 315 is provided in the sidewall of return tube 305 and is in fluid communication through a check valve assembly 317, similar to those described in connection with FIG. 5, with the interior annulus defined between lower outer tube 303B and the tubes carried therein. Thus, fluid from this interior annulus may be pumped into return tube 305 from the interior annulus, while preventing fluid in return tube 305 from entering the interior annulus.

A solenoid-actuated flapper valve 319 is disposed in return tube 305 and is rated at 10,000 psig to hold pressure below valve 319. Flapper valve 319 is closed to capture fluid in return tube 305 when tripping drillstring 1. A pair of check valves 321 are disposed in passages in the lower portion of lower outer tube 303B in communication with high-pressure tubes 307, 313. As described with reference to FIG. 1, check valves 321 prevent reverse circulation of drilling fluid up high-pressure tubes 307, 313. A return tube extension 323 is threaded to the lower portion of lower outer tube 303B in fluid communication with return tube 305.

An earth-boring bit 401 of the fixed cutter variety is secured by a conventional, threaded pin-and-box connection to the lowermost end of lower outer tube 303B. Bit 401 includes a bit face 403 having a plurality of hard, preferably diamond, cutters arrayed thereon in a conventional bladed arrangement. A return passage 405 extends through bit 401 from an eccentric portion of bit face 403 into fluid communication with return tube extension 323 and return tube 305 to establish the return conduit for drilling fluid, cuttings, and annulus fluid mixed therewith.

Four diametrically spaced high-pressure passages 407 extend through bit 401 and intersect a generally transverse passage 409, which is obstructed by a threaded, brazed, or welded plug 411. A plurality of nozzles 413 extend from transverse passage 409 to deliver high-pressure drilling fluid to the borehole bottom. Preferably, the total flow area of nozzles 413 is 0.060 square inch. Preferably, the bit is an API 9⅞ inch gage bit used in conjunction with the 7⅞ inch outer diameter drill pipe 101.

The method and apparatus according to the present invention present a number of advantages. Chiefly, the present invention provides a method and apparatus for drilling with reduced solid content drilling fluid while maintaining a dense, filter-cake-building fluid in the annulus as drilling progresses. The method and apparatus are more commercially practicable than prior attempts. Additionally, the method according to the present invention is particularly adapted to be automated and computer controlled.

The invention has been described with reference to the preferred embodiment thereof. It is not thus limited but is susceptible to modification and variation without departing from the scope and spirit of the invention.

I claim:

1. A method of drilling a borehole comprising the steps of:

running a drillstring terminating in a drill bit into a borehole;

pumping a reduced solid content drilling fluid through the drillstring and out the bit, wherein the drilling fluid impinges upon and disintegrates formation material in cooperation with the bit;

continuously pumping an annulus fluid having a density greater than that of the drilling fluid into an annulus between the borehole and drillstring while drilling formation material, wherein the annulus fluid extends substantially from the earth's surface to the bit;

returning the drilling fluid and cuttings resulting from disintegration of formation material to the earth's surface through a substantially unobstructed tubular return passage in the drillstring; and maintaining the annulus fluid under a selected pressure in the annulus, wherein an interface is formed at the drill bit at which annulus fluid mixes with the drilling fluid and is returned along with the drilling fluid and cuttings, but drilling fluid is substantially prevented from entering the annulus.

2. The method according to claim 1 wherein the step of maintaining the annulus fluid under a selected pressure further comprises the steps of:

selectively choking the flow of fluid and cuttings in the return passage to control the pressure loss across a choke in the return passage;

pumping the drilling fluid into the drillstring and out the bit at a flow rate sufficient to maintain the interface between the drilling and annulus fluid as drilling progresses; and monitoring the selected pressure of the annulus fluid and choking of the drilling fluid.

3. The method according to claim 1 further comprising the steps of:

shutting-in the drilling fluid, including the drilling fluid and cuttings in the tubular return passage, in the drillstring at the earth's surface and at the bit;

connecting a length of drill pipe into the drillstring while the drillstring is shut-in; and opening the drillstring to continue drilling.

4. The method according to claim 1 wherein the drilling fluid is clear water.

5. The method according to claim 1 wherein the drilling fluid is clarified drilling mud.

6. The method according to claim 1 wherein the annulus fluid is a dense, filter-cake-building drilling mud.

7. A method of drilling a borehole comprising the steps of:

running into a borehole a drillstring including at least one high-pressure conduit and at least one tubular return conduit within the drillstring, the drillstring terminating in a drill bit;

pumping a reduced solid content drilling fluid through the high-pressure conduit and out the bit, wherein the drilling fluid impinges upon and disintegrates formation material in cooperation with the bit;

continuously pumping an annulus fluid having a density greater than that of the drilling fluid into an annulus between the borehole and drillstring while drilling formation material, wherein the annulus fluid extends substantially from the earth's surface to the bit;

returning the drilling fluid and cuttings resulting from disintegration of formation material and excess annulus fluid to the earth's surface through the tubular return conduit in the drillstring;

maintaining the annulus fluid under a selected pressure in the annulus, wherein an interface is formed at the drill bit at which annulus fluid mixes with the drilling fluid and is returned along with the drilling fluid and cuttings, but drilling fluid is substantially prevented from entering the annulus;

periodically shutting-in the drilling fluid in the drillstring at the earth's surface and at the bit;

subsequently connecting a length of drill pipe into the drillstring while the drillstring is shut-in; and subsequently opening the drillstring to continue drilling.

8. The method according to claim 7 wherein the shutting-in step comprises:

closing a valve member in the return conduit of the drillstring at the earth's surface; and closing a valve member in the high-pressure conduit of the drillstring proximal the bit, wherein all fluid in the drillstring is substantially prevented from exiting the drillstring.

9. The method according to claim 7 wherein the step of maintaining the annulus fluid under a selected pressure further comprises the steps of:

selectively choking the flow in the return conduit at the earth's surface to control the pressure loss across a choke in the return conduit; and pumping drilling fluid into the high-pressure conduit and out the bit at a flow rate sufficient to maintain the selected pressure and the interface between the drilling and annulus fluid as drilling progresses; and monitoring the selected pressure of the annulus fluid and the choking of the drilling fluid.

10. The method according to claim 7 wherein the drilling fluid is clear water.

11. The method according to claim 7 wherein the drilling fluid is clarified drilling mud.

12. The method according to claim 7 wherein the annulus fluid is a dense, filter-cake-building drilling mud.

13. A method of drilling a borehole comprising the steps of:

running into a borehole a drillstring including at least one high-pressure conduit and at least one tubular return conduit within the drillstring, the drillstring terminating in a drill bit;

pumping a reduced solid content drilling fluid through the high-pressure conduit and out the bit, wherein the drilling fluid impinges upon and disintegrates formation material in cooperation with the bit;

maintaining an annulus fluid having a density greater than the drilling fluid at a selected pressure in an annulus between the drillstring and borehole by pumping drilling fluid into the high-pressure conduit and the annulus fluid into the annulus at flow rates sufficient to maintain an interface between the drilling and annulus fluid as drilling progresses;

returning the drilling fluid and cuttings resulting from disintegration of formation material to the earth's surface through the tubular return conduit in the drillstring, wherein an interface between the drilling and annulus fluid is formed at the drill bit that substantially prevents the drilling fluid from entering the annulus;

selectively choking the return conduit to control the pressure loss across a choke in the return conduit; and monitoring the selected pressure, choking, and flow rates.

14. The method according to claim 13 further comprising the steps of:

periodically shutting-in the drilling fluid in the drillstring at the surface and at the bit;

subsequently connecting a length of drill pipe into the drillstring while the drillstring is shut-in; and subsequently opening the drillstring to continue drilling.

15. The method according to claim 14 wherein the shutting-in step comprises:

closing a valve member in the return conduit of the drillstring at the surface; and closing a valve member in the high-pressure conduit of the drillstring proximal the bit, wherein all fluid in the drillstring is substantially prevented from exiting the drillstring.

16. The method according to claim 7 wherein the drilling fluid is clear water.

17. The method according to claim 13 wherein the drilling fluid is clarified drilling mud.

18. The method according to claim 13 wherein the annulus fluid is a dense, filter-cake-building drilling mud.

19. The method according to claim 13 wherein the step of maintaining the annulus fluid at a selected pressure further comprises the step of:

selectively altering the flow rate at which drilling fluid is pumped into the drillstring.

20. A multiple conduit drill pipe for use in drilling earthen formations, the drill pipe comprising:

an outer tubular conduit for transmitting torsional load;

at least one reduced-diameter tubular conduit for conducting high-pressure fluid through the drill pipe, the reduced-diameter tubular conduit being eccentrically disposed in the tubular outer conduit;

at least one enlarged-diameter tubular conduit, having a diameter greater than that of the reduced-diameter tubular conduit, the enlarged-diameter tubular conduit being eccentrically disposed in the outer tubular conduit; and a closure member for selectively obstructing the enlarged-diameter tubular conduit, the closure member not substantially constricting the diameter of the enlarged-diameter tubular conduit in an open position; and means at each end of the tubular outer conduit for connecting the outer tubular, reduced-diameter, and enlarged diameter conduits to those of similar sections of drill pipe.

21. The multiple conduit drill pipe according to claim 20 further comprising:

a pair of reduced-diameter tubular conduits;

an electrical conduit disposed eccentrically in the outer tubular conduit for carrying an electrical conductor in the drill pipe.

22. The multiple conduit drill pipe according to claim 20 wherein the closure member is a ball valve operable from the exterior of the outer tubular conduit.

23. The multiple conduit drill pipe according to claim 20 wherein each of the conduits disposed in the outer tubular conduit is secured at each end thereof to the outer tubular conduit.

24. The multiple conduit drill pipe according to claim 20 further comprising:

a closure member at each end of the outer tubular conduit that is closed when the drill pipe is not connected to another section of drill pipe, but is open when the drill pipe is connected to another similar section of drill pipe, such that the outer tubular conduits of the sections of connected drill pipe are in fluid communication.

25. A multiple conduit drill pipe for use in drilling earthen formations, the drill pipe comprising:

an outer tubular conduit for transmitting torsional load;

at least one reduced-diameter tubular conduit for conducting high-pressure fluid through the drill pipe;

at least one enlarged-diameter tubular conduit, having a diameter greater than that of the reduced-diameter tubular conduit; and a closure member for selectively obstructing the enlarged-diameter tubular conduit, the closure member not substantially constricting the diameter of the enlarged-diameter tubular conduit in an open position; and means at each end of the tubular outer conduit for connecting the outer tubular, reduced-diameter, and enlarged diameter conduits to those of similar sections of drill pipe.

26. The multiple conduit drill pipe according to claim 25 wherein the reduced-diameter tubular conduit is eccentrically disposed in the tubular outer conduit.

27. The multiple conduit drill pipe according to claim 25 wherein the enlarged-diameter tubular conduit is eccentrically disposed in the outer tubular conduit.

28. The multiple conduit drill pipe according to claim 25 further comprising:

a pair of reduced-diameter tubular conduits;

an electrical conduit disposed eccentrically in the outer tubular conduit for carrying an electrical conductor in the drill pipe.

29. The multiple conduit drill pipe according to claim 25 wherein the closure member is a ball valve operable from the exterior of the outer tubular conduit.

30. The multiple conduit drill pipe according to claim 25 wherein each of the conduits disposed in the outer tubular conduit is secured at each end thereof to the outer tubular conduit.

31. The multiple conduit drill pipe according to claim 25 further comprising:

a closure member at each end of the reduced-diameter tubular conduit that is closed when the drill pipe is not connected to another section of, but is open when the drill pipe is connected to another section of similar drill pipe having a corresponding reduced-diameter tubular conduit;

a closure member at each end of the outer tubular conduit that is closed when the drill pipe is not connected to another section of drill pipe, but is open when the drill pipe is connected to another similar section of drill pipe, such that the outer tubular conduits of the sections of connected drill pipe are in fluid communication.

32. A multiple conduit drill pipe for use in drilling earthen formations, the drill pipe comprising:

an outer tubular conduit for transmitting torsional load;

at least one reduced-diameter tubular conduit for conducting high-pressure fluid through the drill pipe;

at least one enlarged-diameter tubular conduit, having a diameter greater than that of the reduced-diameter tubular conduit; a closure member for selectively obstructing the enlarged-diameter tubular conduit, the closure member not substantially constricting the diameter of the enlarged-diameter tubular conduit in an open position;

a closure member at each end of the outer tubular conduit that is closed when the drill pipe is not connected to another section of drill pipe, but is open when the drill pipe is connected to another similar section of drill pipe, such that the outer tubular conduits of the sections of connected drill pipe are in fluid communication; and means at each end of the tubular outer conduit for connecting the outer tubular, reduced-diameter, and enlarged diameter conduits to those of similar sections of drill pipe.

33. The multiple conduit drill pipe according to claim 32 wherein the reduced-diameter tubular conduit is eccentrically disposed in the tubular outer conduit.

34. The multiple conduit drill pipe according to claim 32 wherein the enlarged-diameter tubular conduit is eccentrically disposed in the outer tubular conduit.

35. The multiple conduit drill pipe according to claim 32 further comprising:

a pair of reduced-diameter tubular conduits;

an electrical conduit disposed eccentrically in the outer tubular conduit for carrying an electrical conductor in the drill pipe.

36. The multiple conduit drill pipe according to claim 32 wherein the closure member is a ball valve operable from the exterior of the outer tubular conduit.

37. The multiple conduit drill pipe according to claim 32 wherein each of the conduits disposed in the outer tubular conduit is secured at each end thereof to the outer tubular conduit.

* * * * *